United States Patent [19]

Farley, Jr.

[11] 4,170,250

[45] Oct. 9, 1979

[54] LOOM HARNESS MECHANISM

[75] Inventor: Arthur C. Farley, Jr., Greensboro, N.C.

[73] Assignee: Cone Mills Corporation, Greensboro, N.C.

[21] Appl. No.: 759,966

[22] Filed: Jan. 17, 1977

[51] Int. Cl.[2] ..... D03C 5/04

[52] U.S. Cl. ..... 139/79

[58] Field of Search ..... 139/79–81, 139/55–57, 79, 80, 81, 55.1, 56, 57

[56] References Cited

U.S. PATENT DOCUMENTS

| | | | |
|---|---|---|---|
| 782,569 | 2/1905 | Lacey | 139/79 |
| 2,580,994 | 1/1952 | Budzyna et al. | 139/79 |
| 3,173,452 | 3/1965 | Juillard | 139/79 X |

FOREIGN PATENT DOCUMENTS

| | | | |
|---|---|---|---|
| 3016 | of 1862 | United Kingdom | 139/79 |
| 605885 | 8/1948 | United Kingdom | 139/79 |

OTHER PUBLICATIONS

The Mechanism of Weaving, Thomas W. Fox, MacMillan & Co., Ltd., London, 1922 pp. 25–44.

*Primary Examiner*—James Kee Chi

*Attorney, Agent, or Firm*—David Rabin

[57] ABSTRACT

A loom mechanism and method which delays the harness crossing and provides tighter, more uniform beat-up during the weaving process.

3 Claims, 5 Drawing Figures

LOOM HARNESS MECHANISM

BACKGROUND AND OBJECTIVES OF THE INVENTION

Figure 1:
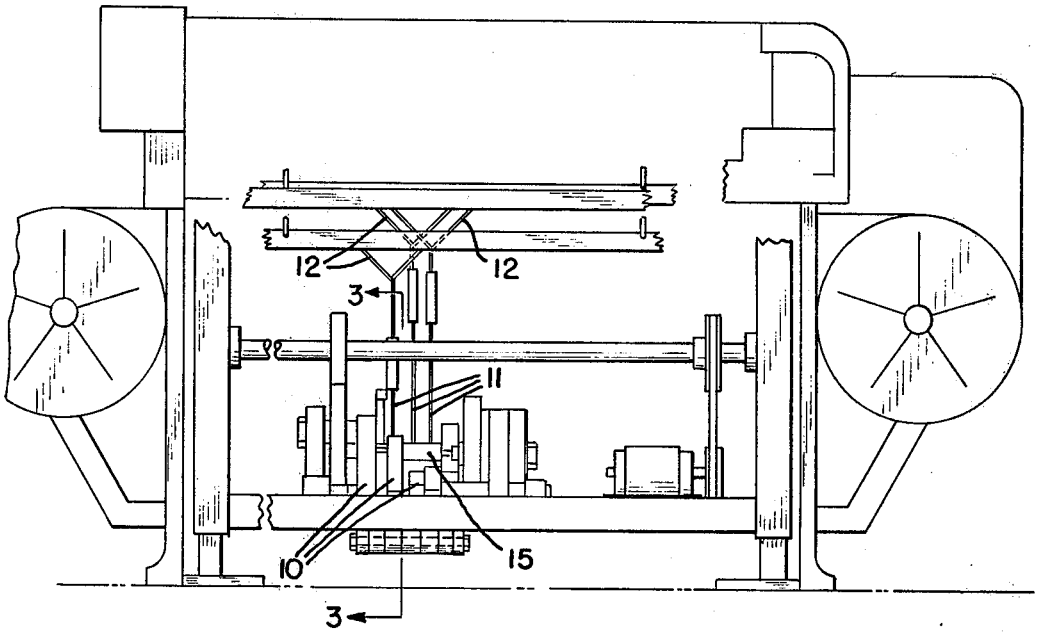

During weaving, a shed or opening is formed between the top and bottom warp yarns as they cross and recross through a center axis. The top and bottom yarns or "warps" are supported by harness members which control their action and the harness members are suitably connected to treadle levers which are raised and lowered in accordance with the motion of harness cams which the treadle levers or treadles are in contact with.

As the top and bottom warp yarns open to form the shed, inserted therebetween is a weft or filling yarn or "pick" sometimes referred to as the "pick of filling". This pick is urged tightly into the fell of the fabric (where the top and bottom warps meet) by the action of a loom reed. As the reed begins urging the pick into the fell the warps of yarn begin crossing and contacts the pick prior to its reaching the fell and final beat-up or compactment by the reed. Consequently, the scissoring or "squeezing" action which is applied by the crossing warps to the pick sometimes prevents the pick from being compacted or completely nudged into the fell. This incomplete beat-up of the pick can oftentimes result in a fabric having a shaded appearance due to the pick of filling, which is often lighter yarn than the warp yarns, showing through, or blossoming to the surface of the fabric, because the crossing warps which pinch or squeeze the pick of filling yarn prior to beat-up tend to pull the pick up and down between the warp yarns and it rises to the surface of the fabric. The shading effect is generally more noticeable on one side of the fabric due to the pick being released on one side prior to the release by the pick insertion mechanism on the opposite side.

In addition to shading problems, conventional harness control assemblies contribute to other problems during the weaving process such as pick insertion tape breakage, wear of various harness parts, low loom weaving efficiency and poor quality of fabrics woven, and the fabrics thus produced often have to be disposed of as "seconds".

With this background in mind, the present invention was conceived and one of its objectives is to provide a loom mechanism which delays the harness crossing approximately 40° during the weaving cycle beyond the timing normally found in a 360° weaving cycle.

It is another objective of the present invention to provide a loom mechanism which will allow the harness to cross at approximately 320° of the weaving cycle.

It is another objective of the present invention to provide a loom mechanism which will reduce the pick insertion tape breakage.

It is yet another objective of the present invention to provide a loom mechanism which will reduce the wear and breakage of the various harness parts and will provide longer usage life.

It is still another objective of the present invention to provide a loom mechanism which will improve the efficiency of the loom and reduce the yardage of "seconds".

SUMMARY OF THE INVENTION AND DESCRIPTION OF THE DRAWINGS

This invention provides a harness mechanism which allows a delay in the crossing of the harnesses to insure more complete beat-up by the reed. In the normal weaving process the harnesses cross at approximately 280° of the weaving cycle at which time the pick may be two inches or more from the fell of the cloth. During crossing, the warp yarns making up the top and bottom layers of the shed engage the pick as it is being urged toward the fell by the reed. The engagement of the pick by the warp yarns prevents complete "beat-up" by the reed and consequently, shading which is caused by the light pick yarns showing through the warp yarns in this cloth, may develop.

The invention herein prevents shading and improper "beat-up" due to the novel contoured surface of the harness cams which causes a delay in the crossing action of the harnesses from approximately 280° to approximately 320° of the weaving cycle, thus allowing the pick to be positioned much nearer the fell, approximately 1" or less, prior to the harness crossing and warp yarn engagement with the pick. It should be noted that merely delaying the loom timing does not produce the desired results and recontouring of the cams must be performed in order to obtain the benefits sought. Because of the delayed harness crossing and later engagement by the warp yarns, as occurs with the novel cams herein, the pick is more uniformly and more completely "beat-up" and the cloth thus produced is more uniformly woven and presents a more even texture and color after finishing. Also, the harnesses cross at a lower vertical level than before due to the novel contoured camming surfaces and the crossing action is at a point below the previous centerline as established by the conventional harness cams.

Figure 3:
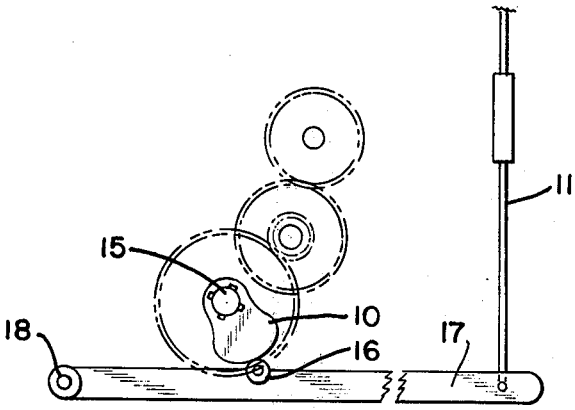
Figure 5:
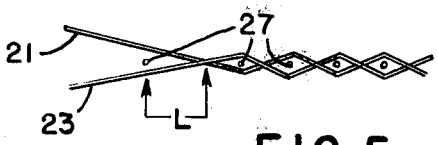
Figure 4:
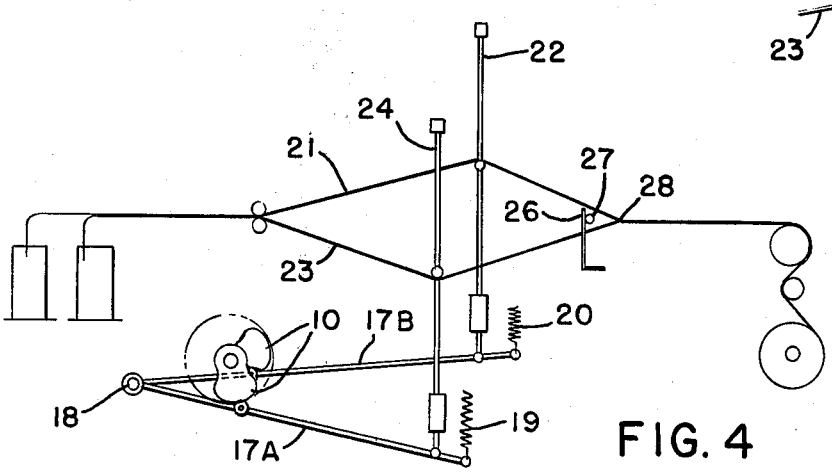
Figure 2:
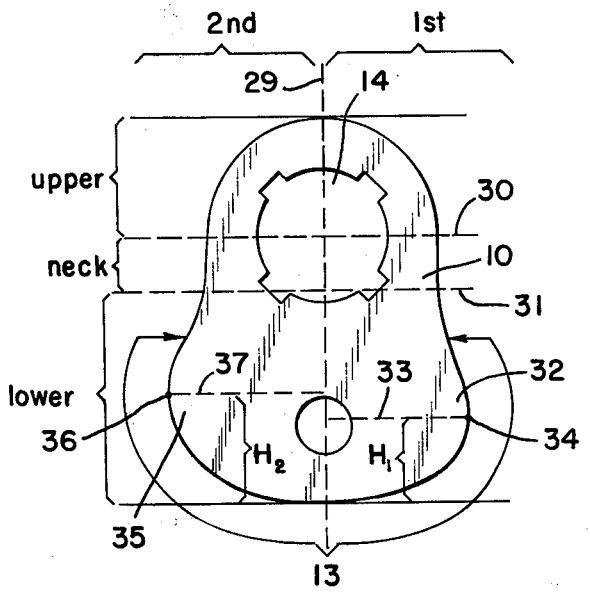

FIG. 1 is a front perspective view of a typical weaving loom;

FIG. 2 demonstrates a side view of the novel cam described herein;

FIG. 3 presents in schematic form the novel cam positioned for harness control;

FIG. 4 is a schematic view of the loom harness operation during the weaving cycle; and FIG. 5 is a schematic view of the fell and woven fabric.

For a more detailed description of the invention referring to FIG. 1, a typical harness cam mechanism is shown with cams 10 at various positions during their revolution in a typical 3-harness cam set up. Pull-down rods 11 are connected to harness rods 12 which in turn raise and lower the warp yarns in accordance with the contours of the cam surfaces.

In FIG. 2 cam 10 is shown removed from the loom and in this side view the contour of the cam face 13 is easily seen.

The cam structure shown in an upright position in FIG. 2 for explanation purposes is divided into first and second sides along a dotted mid-line 29. Also, the cam is divided into upper, neck and lower sections by dotted lines 30 and 31. First lobal portion 32 is shown in the lower portion of the first side of the cam with dotted line 33 shown at height $H_1$ above the bottom of the cam, from mid-line 29 to the apex 34 of the first lobal portion. In the second lower section of the cam is another lobal portion 35. The apex of lobal portion 35 is shown at 36 and apex 36 has a greater vertical height $H_2$ than apex 34 of the first lobal portion. As illustrated, apex 34 is the point having the greatest distance from mid-line 29 in lobal portion 32 and apex 36 is a point furthest from mid-line 29 in lobal portion 35. As seen in the drawings, the upper portion of cam 10 is above dotted line 30 in FIG. 2 and is divided into equal sides by dotted line 29. Between lines 30 and 31 is the indented portion of the cam and below line 31 is the lower portion containing the side lobes 32 and 35. Opening 14 allows cam 10 to be positioned on cam shaft 15 and rigidly affixed to prevent slippage during its operation.

FIG. 3 demonstrates cam 10 in position and contacting treadle roller 16 which rests upon treadle 17. Pull-down rod 11 is pivotably connected to treadle 17 and pivots about treadle shaft 18. While only one cam is shown in FIG. 3, various harness arrangements can be utilized employing two or more cams as required depending on the particular loom and weaving application.

FIG. 4 demonstrates in schematic form cam 10 and its operation relative to the weaving process. As shown, treadle 17A is shown in its downward position with spring member 19 fully extended. Treadle member 17B is shown in its upward or lifted position with spring member 20 being fully contracted or relaxed. Upper warp yarn 21 is pictured in its highest position, being lifted by harness mechanism 22. Lower warp yarn 23 is shown in its lowermost position being urged downward by harness assembly 24. Loom reed 26 is shown in contact with pick 27 as reed 26 begins to urge pick 27 into the shed or recess formed by warp yarns 21 and 23. As reed 26 beats-up pick 27 into fell 28 the harness mechanism will cross when pick 27 is approximately 1" from fell 28 at 310°-330° or approximately 320° of the weaving cycle. As the warp yarns reverse and warp yarn 23 then becomes the top warp and with warp yarns 21 becoming the lower warp then another pick will be inserted into the shed and the cycle will be repeated. As shown, the harness cam 10 controls the crossing action of the harnesses and delays the warp yarns' engagement with the pick until the pick is almost completely beat-up into the fell. Harness cam 10 causes the sheds to reopen for the next pick insertion as conventionally provided at approximately 0°-15° of the next weaving cycle.

In FIG. 5 top warp yarn 21 and bottom warp yarn 22 are shown in a schematic side view as they contact pick 27 in their crossing action. Reed 26 (not shown) continues to urge pick 27 into fell 28. As shown in this diagram the warp yarn contacts pick 27 when L equals approximately 1 inch.

Various modifications and improvements in the structure shown can be made however, the drawings and embodiments presented are strictly for illustrative purposes and are not intended to limit the scope of the invention contained herein.

I claim:

1. A loom mechanism for delaying the harness crossing during the weaving cycle comprising a pair of cams, said cams having sides and a surrounding outer camming surface, said camming surface forming at least one lobe on each side of the cam, said first cam lobe being of a lower vertical height than said second cam lobe, pivotable treadles engaging said cams' outer camming surfaces, a harness assembly joined to said treadles, said harness assembly having at least two crossable harness members each for supporting different warps of yarn, said cams' outer camming surfaces being contoured allowing said harness members to cross between 310°-330° of the weaving cycle.

2. A loom mechanism for delaying the harness crossing during the weaving cycle as claimed in claim 1, and including a plurality of pairs of cams.

3. A loom mechanism for delaying the harness crossing as claimed in claim 1, and including treadle rollers for engagement with said cams' outer camming surfaces.

* * * * *